US010440495B2

(12) United States Patent
Wardle

(10) Patent No.: US 10,440,495 B2
(45) Date of Patent: Oct. 8, 2019

(54) VIRTUAL LOCALIZATION OF SOUND

(71) Applicant: Sony Interactive Entertainment Inc, Tokyo (JP)

(72) Inventor: Scott Wardle, Foster City, CA (US)

(73) Assignee: SONY INTERACTIVE ENTERTAINMENT INC., Tokyo (JP)

( * ) Notice: Subject to any disclaimer, the term of this patent is extended or adjusted under 35 U.S.C. 154(b) by 0 days.

(21) Appl. No.: 15/890,031

(22) Filed: Feb. 6, 2018

(65) Prior Publication Data

US 2019/0246230 A1 Aug. 8, 2019

(51) Int. Cl.

| | |
|---|---|
| ***H04S 7/00*** | (2006.01) |
| ***H04R 5/02*** | (2006.01) |
| ***H04R 5/027*** | (2006.01) |
| ***H04S 3/00*** | (2006.01) |

(52) U.S. Cl.

CPC ..... *H04S 7/303* (2013.01); *H04R 5/02* (2013.01); *H04R 5/027* (2013.01); *H04S 3/008* (2013.01); *H04S 2400/11* (2013.01); *H04S 2400/15* (2013.01); *H04S 2420/01* (2013.01)

(58) Field of Classification Search

CPC ..... H04S 7/303; H04S 3/008; H04S 2400/11; H04S 2400/15; H04S 2420/01; H04R 5/02; H04R 5/027

USPC ..... 381/303, 310, 26, 56.58

See application file for complete search history.

(56) References Cited

U.S. PATENT DOCUMENTS

| | | | | |
|---|---|---|---|---|
| 2014/0037094 | A1* | 2/2014 | Ma | H04R 3/02 381/56 |
| 2014/0198918 | A1* | 7/2014 | Li | H04S 7/30 381/26 |
| 2018/0091925 | A1* | 3/2018 | Norris | H04M 1/72572 |
| 2018/0139563 | A1* | 5/2018 | Mertins | G01H 7/00 |

OTHER PUBLICATIONS

International Search Report dated Mar. 5, 2019 for International Patent Application PCT/US2019/016150.

* cited by examiner

*Primary Examiner* — William A Jerez Lora

(74) *Attorney, Agent, or Firm* — JDI Patent; Joshua Isenberg; Robert Pullman

(57) ABSTRACT

A method for improved virtual localization of sound comprises making a sound at an origin point, recording the sound with two or more recording devices at, two or more different distances from the origin point, generate a head-related transfer function (HRTF) for each of signals received from the two or more recording devices at the two or more different distances from the origin point, convolving a waveform with a localized HRTF generated using at least one of the HRTFs, and drive a speaker with the convolved waveform.

18 Claims, 11 Drawing Sheets

VIRTUAL LOCALIZATION OF SOUND

FIELD OF THE DISCLOSURE

The current disclosure relates to audio signal processing. More specifically, the current disclosure relates optimization of sounds in a multi-speaker system.

BACKGROUND

Human beings are capable of recognizing the source location, i.e., distance and orientation, of sounds heard through the ears through a variety of auditory cues related to head and ear geometry, as well as the way sounds are processed in the brain. Surround sound systems attempt to enrich the audio experience for listeners by outputting sounds from various locations which surround the listener.

Typical surround sound systems utilize an audio signal having multiple discrete channels that are routed to a plurality of speakers, which may be arranged in a variety of known formats. For example, 5.1 surround sound utilizes five full range channels and one low frequency effects (LFE) channel (indicated by the numerals before and after the decimal point, respectively). For 5.1 surround sound, the five full range channels would then typically be arranged in a room with three of the full range channels arranged in front of the listener (in left, center, and right positions) and with the remaining two full range channels arranged behind the listener (in left and right positions). The LFE channel is typically output to one or more subwoofers (or sometimes routed to one or more of the other loudspeakers capable of handling the low frequency signal instead of dedicated subwoofers). A variety of other surround sound formats exists, such as 6.1, 7.1, 10.2, and the like, all of which generally rely on the output of multiple discrete audio channels to a plurality of speakers arranged in a spread out configuration. The multiple discrete audio channels may be coded into the source signal with one-to-one mapping to output channels (e.g. speakers), or the channels may be extract from a source signal having fewer channels, such as a stereo signal with two discrete channels, using other techniques like matrix decoding to extract the channels of the signal for playout.

Surround sound systems have become popular over the years in movie theaters, home theaters, and other system setups, as many movies, television shows, video games, music, and other forms of entertainment take advantage of the sound field created by a surround sound system to provide an enhanced audio experience for listeners. However, there are several drawbacks with traditional surround sound systems, particularly in home theater applications. For example, creating an ideal surround sound field is typically dependent on optimizing the physical setup of the speakers of the surround sound system, but sometimes the speakers may not be set up or arranged as desired due to physical constraints and other limitations. Thus, there is a need to simulate an optimal surround sound field to provide high quality audio experience even under the circumstances where the speakers cannot or are not arranged or installed as required. In other words, it is desirable to recreate a perception in the listener that the sounds are localized as if they are originated from desired locations which may be independent from the location of the speakers.

It has been proposed that the source location of a sound can be simulated by manipulating the source signal to sound as if it originated from a desired location, a technique often referred to in audio signal processing as "sound localization." Many known audio signal processing techniques attempt to recreate sound fields which simulate spatial characteristics of a source audio signal using what is known as a Head Related Impulse Response (HRIR) function or Head Related Transfer Function (HRTF). A HRTF is generally a Fourier transform of its corresponding time domain head-related impulse response (HRIR).

It is within this context that aspects of the present disclosure arise.

BRIEF DESCRIPTION OF THE DRAWINGS

Aspects of the present disclosure can be readily understood by considering the following detailed description in conjunction with the accompanying drawings, in which.

DESCRIPTION OF THE SPECIFIC EMBODIMENTS

Although the following detailed description contains many specific details for the purposes of illustration, anyone of ordinary skill in the art will appreciate that many variations and alterations to the following details are within the scope of the invention. Accordingly, the exemplary embodiments of the invention described below are set forth without any loss of generality to, and without imposing limitations upon, the claimed invention.

INTRODUCTION

Aspects of the present disclosure relate to convolution techniques for processing a source audio signal in order to localize sounds in a multi-speaker system. A method according to aspects of the present disclosure provides sound localization by convolving a source audio signal so that the audio signal reproduced by the speakers is perceived as if it originates from a desired location rather than the location of the speakers. The method according to some aspects of the present disclosure generates a HRTF by interpolating reference HRTFs that have been previously determined at various distances from a point source.

Specifically, a method according to the present disclosure comprises recording a sound from an origin point with two or more recording devices at, two or more different distances from the origin point, generating a head-related transfer function for each of signals received from the two or more recording devices at the two or more different distances from the origin point, convolving a waveform with a localized HRTF generated using at least one of the generated HRTFs, and driving a speaker with the convolved waveform. Each of the two or more recording devices may be configured to simulate a human head and ears may include two or more microphones.

Driving loudspeakers with a convolved waveform is most practical and effective when either the loudspeakers in question are the two speakers of a headphone, directly coupled to the left and right ears, respectively, of the listener or if two loudspeakers are chosen from among several loudspeakers of a surround sound system and these two loudspeakers are driven with the output of a crosstalk canceller, which in turn is driven by the HRTF-convolved signals.

Implementation Details

Figure 1A:
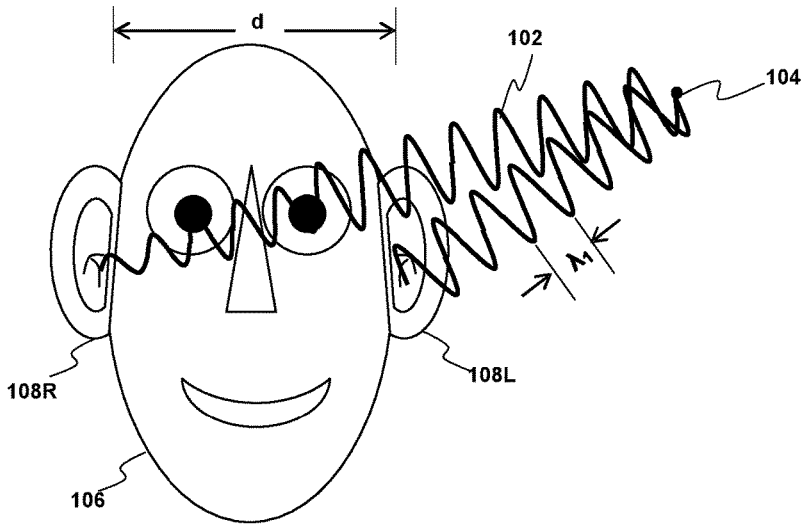
FIG. 1A is a schematic diagram depicting a human head listening to a high frequency component of a sound originating from a location to illustrate various aspects of the present disclosure.
Figure 1B:
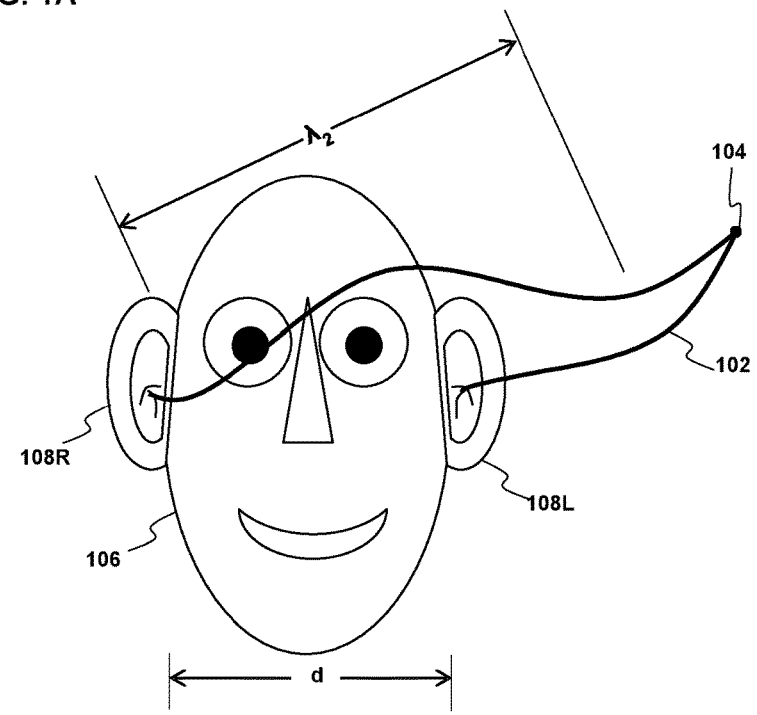
FIG. 1B is a schematic diagram depicting a human head listening to a low frequency component of the sound of FIG. 1A to illustrate various aspects of the present disclosure.

A brief discussion of how spatial differences in sounds are recognized by humans is helpful. Illustrative schematic diagrams of a user 106 hearing a sound 102 originating from a location 104 in space are depicted in FIGS. 1A-1B. In particular, FIGS. 1A-1B illustrate, by way of a simple example, certain principles of how spatial differences in audio affect how sound is received at the human ear and how the human anatomy affects recognition of spatial differences in source locations of sounds.

Generally speaking, acoustic signals received by a listener may be affected by the geometry of the ears, head, and torso of the listener before reaching the transducing components in the ear canal of the human auditory system for processing, resulting in auditory cues that allow the listener to perceive the location from which the sounds came based on these auditory cues.

These auditory cues include both monaural cues resulting from how an individual ear structure (e.g., pinna and/or cochlea) modifies incoming sounds, and binaural cues resulting from differences in how the sounds are received at the different ears.

Spatial audio processing techniques attempt to localize sounds to desired locations in accordance with these principles using electronic models that manipulate the source audio signal in a manner similar to how the sounds would be acoustically modified by the human anatomy if they actually originated from those desired locations, thereby creating a perception that the modified signals originate from the desired locations. Illustrative principles of some of these anatomical manipulations of sounds, and in particular, of interaural differences in the sounds, are depicted in FIGS. 1A-1B.

The schematic diagrams of FIGS. 1A-1B depict the same sound 102 being received at left 108L and right 108R ears of a human head 106. In particular, while the sound 102 illustrated in FIGS. 1A and 1B is the same sound originating from the same location 104, only a high frequency component of the sound is illustrated in FIG. 1A, while only a low frequency component of the sound is illustrated in FIG. 1B. In the illustrated examples, the wavelength $\lambda_1$ of the high frequency component in FIG. 1A is significantly less than a distance d between the two ears of the listener's head, while the wavelength $\lambda_2$ of the low frequency component of the signal illustrated in FIG. 1B is significantly greater than the distance d between the two ears of the user's head 106. As a result of the geometry of the listener's head 106, as well as the head's location and orientation relative to the location 104 of the source of the sound 102, the sound is received differently at each ear 108R,L.

For example, as can be seen in FIG. 1A, the sound 102 arrives at each ear at different times, often referred to as an "interaural time difference" (ITD), and which is essentially a difference in the time delay of arrival of the acoustic signal between the two ears. By way of example, in the situation depicted in FIG. 1A, the sound arrives at the listener's left ear 108L before arriving at the right ear 108R, and this binaural cue may contribute to the listener's recognition of source location 104 as being to the left of the listener's head.

Likewise, as can be more clearly seen in FIG. 1B, in addition to the ITD there may be a phase difference between the sound 102 reaching each ear 108R,L, often referred to as an "interaural phase difference" (IPD), and this additional binaural cue may further contribute to the listener's recognition of the source location 104 relative to the head of the listener 106.

Furthermore, as can be seen in FIG. 1A, the sound 102 arrives at the listener's left ear 108L unobstructed by the listener's anatomy, while the sound is at least partially obstructed by the listener's head before it reaches the right ear 108R, causing attenuation of the sound 102 before reaching the transducing components of the listener's right ear 108R, a process often referred to as "head shadowing." The attenuation of the signal results in what is known as an "interaural level difference" (ILD) between the sounds received at each of the ears 108R,L, providing a further binaural auditory cue as to the location 104 of the source of the sound.

Moreover, as can be seen from a comparison of FIGS. 1A and 1B, various aspects of the binaural cues described above may be frequency dependent. For example, interaural time differences (ITDs) in the sounds may be more pronounced at higher frequencies, such as that depicted in FIG. 1A in which the wavelength is significantly less than a distance d between the two ears, as compared to lower frequencies, such as those depicted in FIG. 1B in which the wavelength is at or significantly greater than the distance d. By way of further example, interaural phase differences (IPDs) may be more pronounced at the lower frequencies, such as that depicted in FIG. 1B in which the wavelength is greater than the distance between the two ears. Further still, a head shadowing effect may be more pronounced at the higher frequencies, such as that depicted in FIG. 1A, than the lower frequencies, such as that depicted in FIG. 1B, because the sounds with the greater wavelengths may be able to diffract around the head, causing less attenuation of the sound by the human head when it reaches the far ear, e.g. right ear 108R in the illustrated example.

In light of the foregoing, attempts have been made to use HRTFs for sound localization. A HRTF characterizes how sound from a particular location that is received by a listener is modified by the anatomy of the human head before it enters the ear canal. Application of a HRTF filter on a source audio signal manipulates the magnitude and phase of the signal so that the listener perceives the sound, when reproduced, comes from a desired location.

The method according to aspects of the present disclosure generates a HRTF and convolves it with a source audio signal so that the sound, when reproduced in speakers of a multi-speaker system, sounds as though it originates from a desired location, rather than from the location of the speakers. Again this is most practical and effective with two speakers of a headphone, respectively coupled to the listener's left and right ears or if two loudspeakers chosen from among several loudspeakers of a surround sound system are driven with the output of a crosstalk canceller, which in turn is driven by the HRTF-convolved signals.

Figure 2:
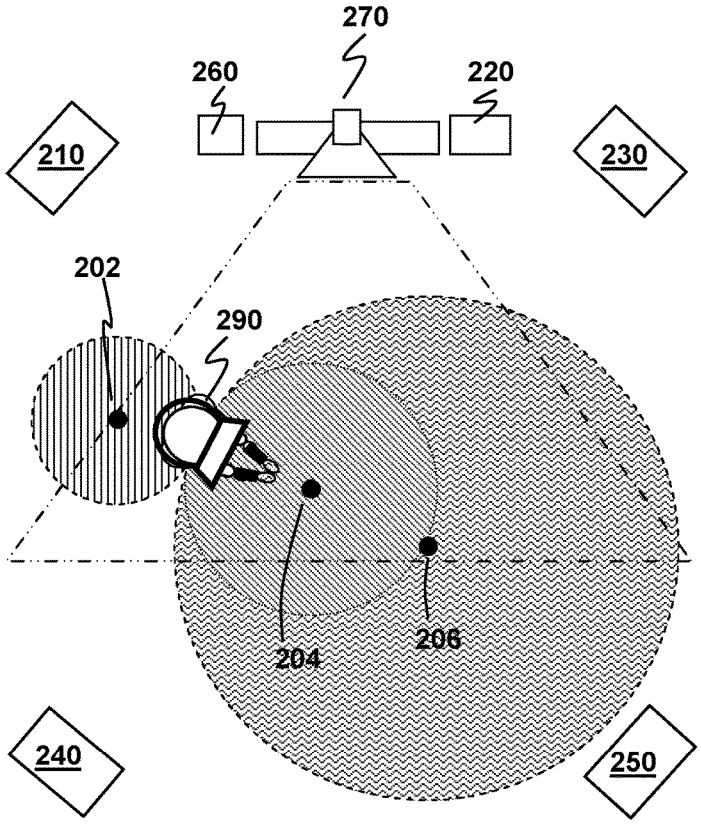
FIG. 2 is a schematic diagram illustrating an example of a user surrounding in a 5.1 speaker system to illustrate various aspects of the present disclosure.
Figure 2:
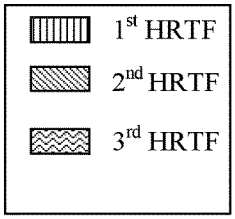

According to aspects of the present disclosure, the method applies both to headphones and to a speaker system having speakers arranged in a standard formation as shown in FIG. 2 as well as a speaker system having speakers arranged in a non-standard formation and driven with both the HRTF-convolved signal and suitable crosstalk cancellation signals. FIG. 2 illustrates a common setup of a 5.1 surround sound system 200 for use with an entertainment system 270 to provide a stereoscopic sound. The entertainment system 270 may include a display device (e.g., LED monitor or television), an entertainment console (e.g., game console, DVD player or setup/cable box) and peripheral devices (e.g., image capturing device or remote control for controlling the entertainment console). The configuration for the surround sound system includes three front speakers (i.e., a left loudspeaker 210, a center loudspeaker 220, and a right loudspeaker 230), two surround speakers (i.e., a left surround loudspeaker 240 and a right surround loudspeaker 250), and a subwoofer 260. Each loudspeaker plays out a different audio signal so that the listener is presented with different sounds from different directions. Each speaker is configured to receive audio for playout via wire or wireless communication. A listener such as listener 290 in FIG. 2 may not be located at the center of the surround sound system 200. In order for the listener 290 to perceive the sounds, when reproduced by the speakers in the system 200, originating from desired locations 202, 204 and 206 rather than the location of the speakers, the method according to aspects of the present disclosure generates a HRTF and convolves the audio signal with the HRTF.

Figure 3:
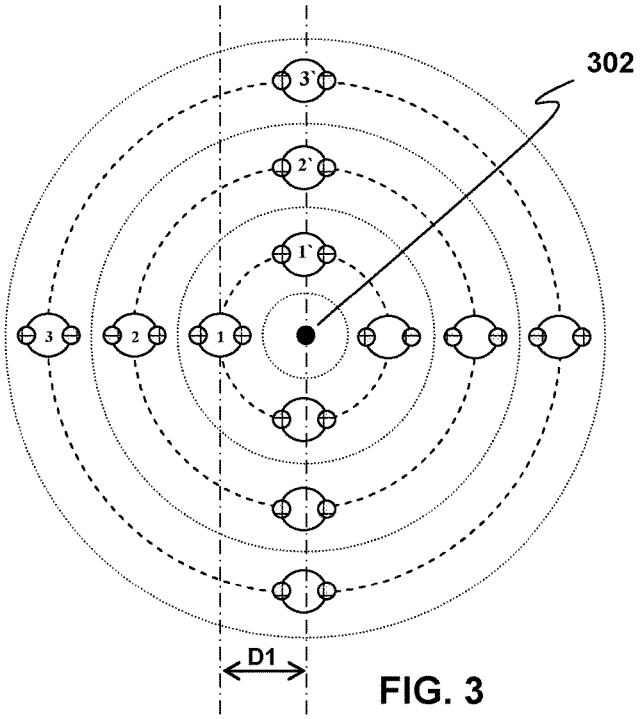
FIG. 3 is a schematic diagram of multiple HRTF recording devices stationed at various distances from a point source to illustrate various aspects of the present disclosure.

In order to generate a HRTF for a particular sound source, a plurality of HRTFs (i.e., reference HRTFs) may be recorded or measured first. FIG. 3 depicts multiple HRTF recording devices (1, 2, 3, 1' . . . ) stationed at various distances from a point source 302 for recording HRTFs. Each of HRTF recording devices may comprise a dummy head and two or more microphones located on either side of the dummy head. Specifically, the dummy head may be made of a material chosen to simulate the density and resonance of the human head. In addition, the dummy head may be in a size similar to an average head. Thus, the two or more microphones are separated by a known horizontal distance which may be equal to the distance between ears on an average head. In some implementations, instead of a dummy head, an actual human head may be used for recording.

Figure 4A:
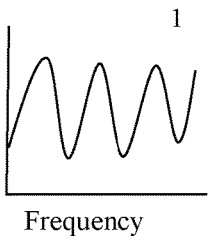
FIGS. 4A-4F are diagrams of the HRTFs recorded by HRTF recording device of FIG. 3.
Figure 4B:
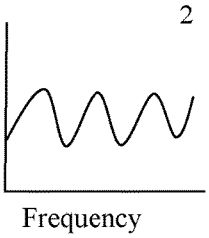
Figure 4C:
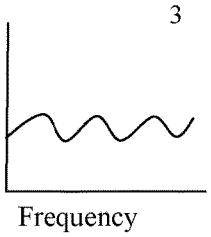
Figure 4D:
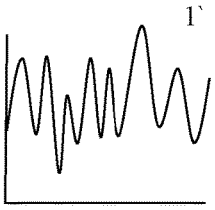
Figure 4E:
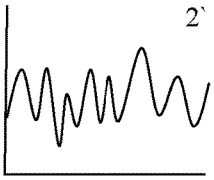
Figure 4F:
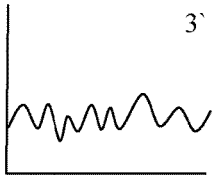

For recordings, the point source 302 may emit a sound wave. The microphones placed inside of each ear canal of the dummy head may capture the response and obtain a recording of how an impulse originating from that particular location is affected by the head anatomy before it reaches the transducing components of the ear canal. FIGS. 4A-4F are diagrams showing the HRTFs collected at various locations from the point source 302. For example, FIG. 4A shows the HRTF determined at the HRTF recording device 1 in the distance D1 from the point source 302 while the sound source is at the right side (or to the east) of the HRTF recording device 1. FIG. 4D shows HRTF determined for the HRTF recording device 1' in the distance D1 from the point source 302 while the sound source is at rear side (or to the south) of the HRTF recording device 1'. While each of the HRTF recording devices 1 and 1' has the same distance from the point source 302, their HRTFs are different as shown in FIGS. 4A and 4D because HRTFs vary depending on the angle of arrival of the acoustic waves.

After a plurality of HRTFs are determined for a point source, a previously-determined HRTF can be convolved with an audio signal so that a listener situated where the corresponding HRTF recording device is located perceives the sound, when reproduced by surround sound speakers, as if it originates from that point source rather than the location of the speakers. In some implementations, the recordings are performed in an echo free environment, such as an anechoic chamber. In other implementations where the recordings are not performed in an echo free environment, the impulse response of the environment may be taken into account for sound localization. Thus, the source audio signal may be convolved not only with the HRTF but also with a Room Response Transfer Function to generate a convolved output signal for reproduction.

In some embodiments where the listener is at a location between or among the HRTF recording devices, interpolation on the recorded HRTFs (i.e., reference HRTFs) nearby may be performed to generate a localized HRTF for convolution. Specifically, two or more reference HRTFs may be selected to generate the localized HRTF. By way of example but not by way of limitation, the selected reference HRTFs may include a first reference HRTF recorded by a HRTF recording device at a distance closest to a distance of the listener from a point source. By way of example but not by way of limitation, the selected reference HRTFs may include reference HRTFs recorded by the two HRTF recording devices that are adjacent to the location of the listener (i.e., the chosen point).

Figure 5A:
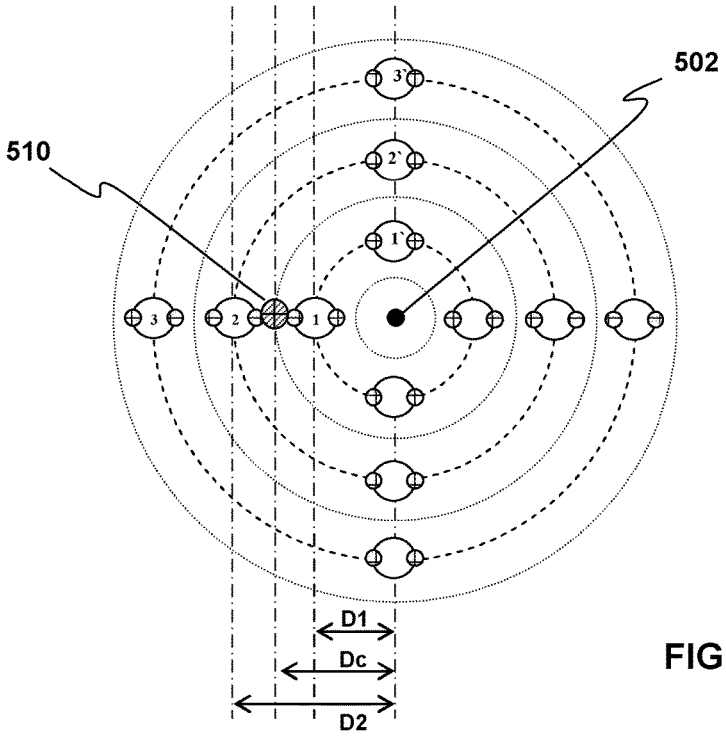
FIG. 5A is a schematic diagram of a chosen point and multiple HRTF recording devices stationed at various distances from a point source to illustrate various aspects of the present disclosure.
Figure 5B:
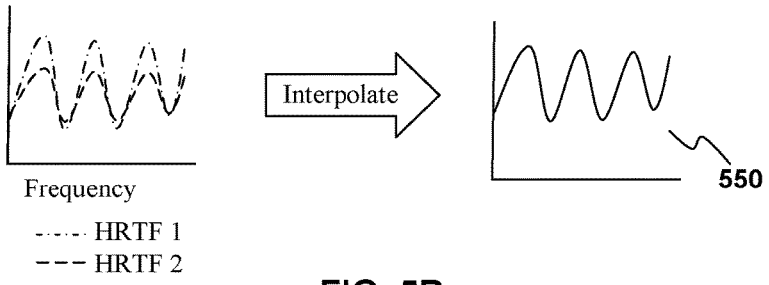
FIG. 5B shows the diagrams of the HRTF generated by interpolation for the chosen point of FIG. 5A according to aspects of the present disclosure.

FIG. 5A depicts a listener (or a chosen point) 510 and multiple HRTF recording devices (1, 2, 3, 1' . . . ) stationed at various distances from a point source 502. As shown in FIG. 5A, the HRTF recording devices 1 and 2 are in a distance (D1 and D2) closest to a distance (Dc) of the chosen point 510 from the point source 502. The HRTF recording devices 1 and 2 are adjacent to chosen point 510. The localized HRTF for the chosen point 510 for sound localization may be generated by performing interpolation on the reference HRTFs recorded by the HRTF recording devices 1 and 2 (i.e., HRTF 1 and HRTF 2). FIG. 5B shows the diagrams of the localized HRTF 550 that is generated by interpolation of the reference HRTF 1 and HRTF 2. With the convolution between the localized HRTF 550 and an audio signal, the sound reproduced by the surround sound speakers sounds as though it originates from the point source 502 regardless the location of the surround sound speakers.

Figure 6A:
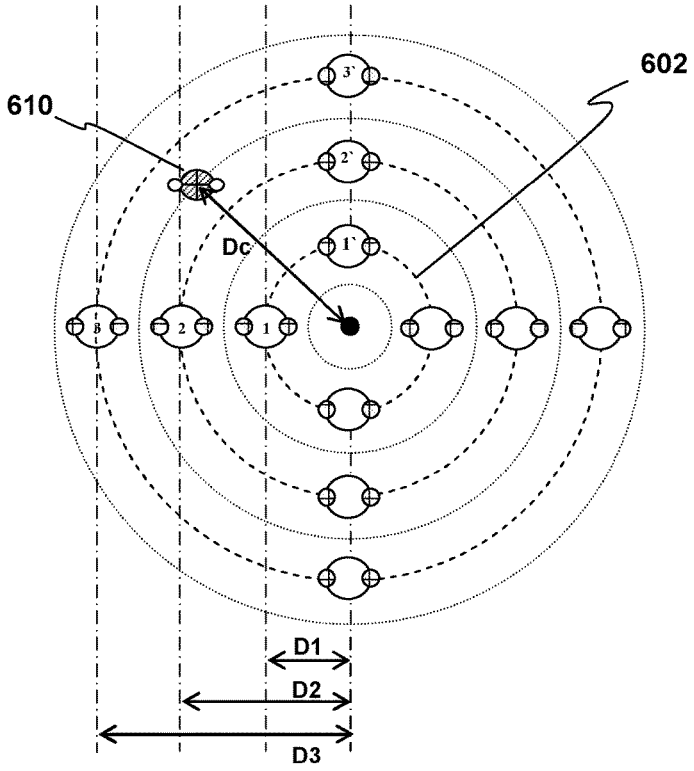
FIG. 6A is a schematic diagram of a chosen point and multiple HRTF recording devices stationed at various distances from a point source to illustrate various aspects of the present disclosure.
Figure 6B:
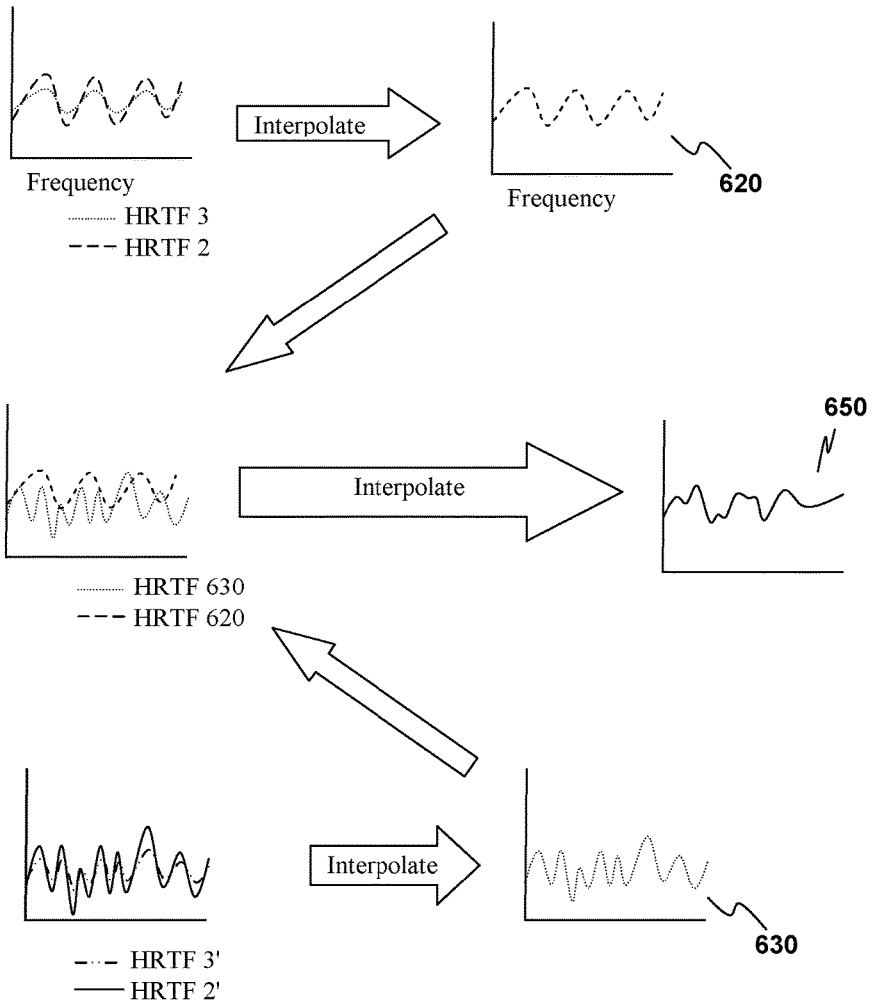
FIG. 6B shows the diagrams of the HRTF generated by interpolation for the chosen point of FIG. 6A according to aspects of the present disclosure.

FIG. 6A depicts another chosen point 610 and multiple HRTF recording devices (1, 2, 3, 1' . . . ) stationed at various distances from a point source 602. As shown in FIG. 6A, the HRTF recording devices 3 and 3' are in a distance (D3) closest to a distance (Dc) of the chosen point 610 from the point source 602. In addition, the HRTF recording devices 2, 2', 3 and 3' are adjacent to chosen point 610. The localized HRTF for the chosen point 610 for sound localization may be generated by performing interpolation on the reference HRTFs recorded by the HRTF recording device 2, 2', 3 and 3' (i.e., HRTF 2, HRTF 2', HRTF 3 and HRTF 3'). In some implementations, e.g., as shown in FIG. 6B, interpolation may be first performed between the HRTF 2 and HRTF 3 and between HRTF 2' and HRTF 3' to generate HRTF 620 and HRTF 630. Then another interpolation may be performed between the HRTF 630 and HRTF 620 to generate the localized HRTF 650 for the chosen point 610. As such, a HRTF for any chosen point may be generated for sound localization with interpolation techniques.

Since a point source produces a spherical wave, the HRTF recording devices need only be placed in one location for each distance. According to some aspects of present disclosure, a HRTF for different angles of the HRTF recording device from a point source may be recorded.

Figure 7A:
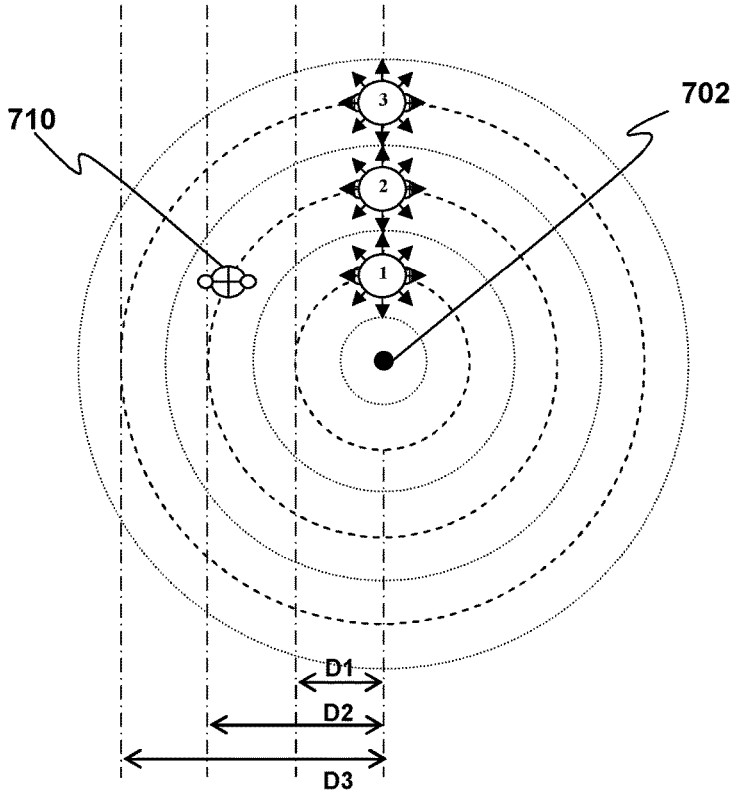
FIG. 7A is a schematic diagram of a chosen point and multiple HRTF recording devices stationed in various distances from a point source to illustrate various aspects of the present disclosure.
Figure 7B:
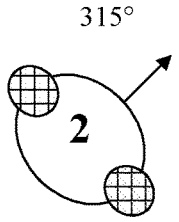
FIG. 7B is a schematic diagram of a HRTF recording devices oriented in an angle to illustrate various aspects of the present disclosure.
Figure 7C:
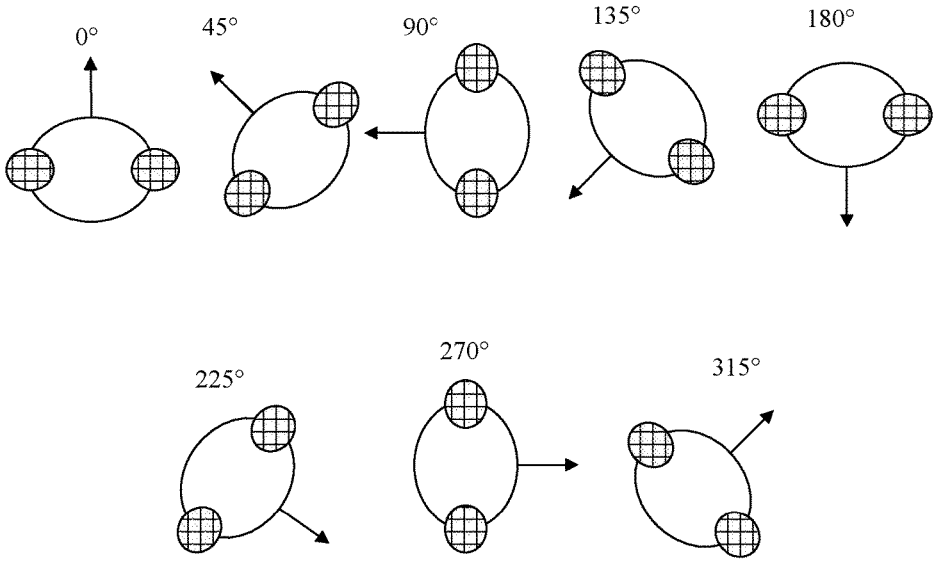
FIG. 7C shows multiple HRTF recording devices oriented in various angles to illustrate various aspects of the present disclosure.

FIG. 7A shows three HRTF recording devices (1, 2, 3) at three different distances (D1, D2 and D3) from a point source 702. The HRTF recording devices (1, 2, 3) may be oriented at different angles for recording as the arrows indicated around the devices in the figure. Any other location at a same distance around the point source may be simulated by simply changing the orientation of the point source. By way of example but not by way of limitation, the HRTF for a listener 710 in FIG. 7A may be simulated using the HRTF generated by the HRTF recording device 2. Specifically, the distance of the listener 710 from the point source 702 is the same as the distance of the HRTF recording device 2 from the source 702. In addition, since the listener 710 faces north and stands to the northwest of the point source, the HRTF for the listener 710 is the same as the HRTF generated by the HRTF recording device 2 oriented toward the northeast as shown in FIG. 7B. Thus, with recording of HRTFs by the HRTF recording devices (1, 2, 3) in various orientations, a HRTF may be generated for any location that is in the same distance from the point source as the recording devices (1, 2, 3). The number of orientation angles and the degree of each orientation angle for the HRTF recording devices during recording may be randomly selected. In some implementations, the recordings for the HRTFs may be performed by the HRTF recording devices oriented at four different angles (reference angles) from a point source (e.g., 0°, 90°, 180°, 270°). In some other implementations, the HRTF recording devices may be oriented in eight different angles (reference angles) from a point source as shown in FIG. 7C. A HRTF for any given angles different from the reference angles may be simulated by interpolating between two HRTFs generated for the angles closest to the given angles.

Figure 8A:
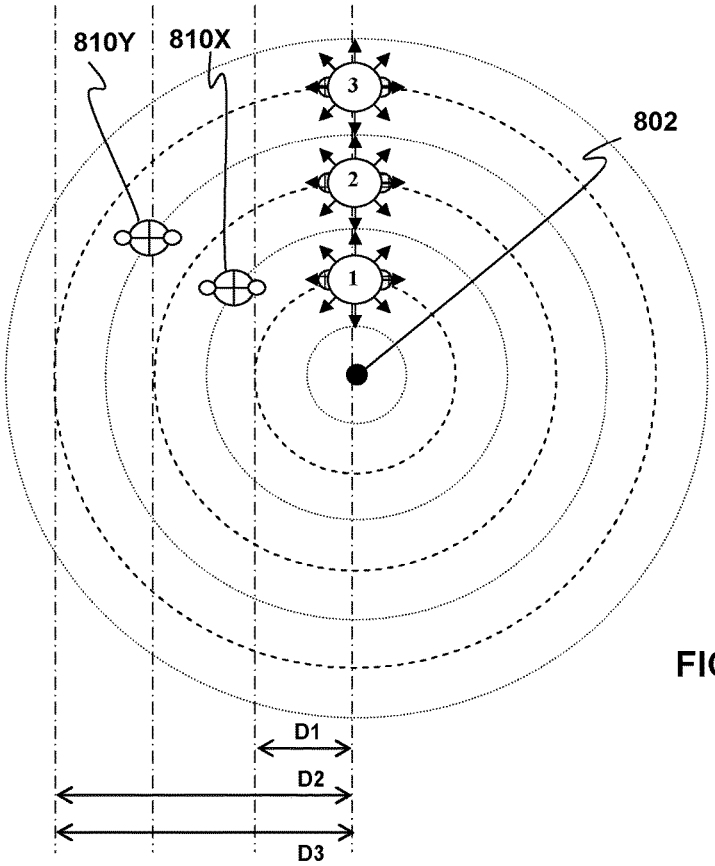
FIG. 8A is a schematic diagram of two chosen points and multiple HRTF recording devices stationed in various distances from a point source to illustrate various aspects of the present disclosure.
Figure 8B:
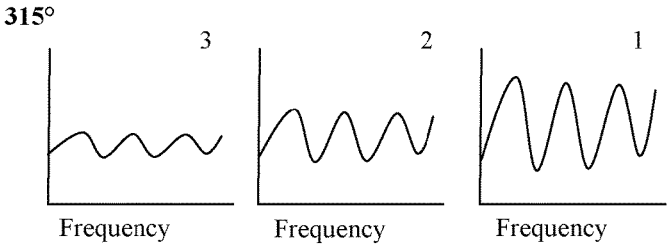
FIG. 8B shows the diagrams of the HRTFs for a specific angle the HRTF recording devices of FIG. 8A are oriented to illustrate various aspects of the present disclosure.

In an alternative implementation the HRTF distance may be simulated by crossfading the audio signals at two different HRTF locations, FIG. 8A shows two chosen points (810X and 810Y) and three HRTF recording devices (1, 2, 3) that are three different distances (D1, D2 and D3) from a point source 802. The distance of the chosen point 810X from the point source 802 is between the distances D1 and D2. The distance of the chosen point 810Y from the point source 802 is between the distances D2 and D3. The chosen points 810X and 810Y faces north and stands to the northwest of the point source 802. According to aspects of the present disclosure the HRTF for the chosen point 810X may be simulated by crossfading the audio levels of a first HRTF generated by the HRTF recording device 1 oriented at an angle of 315 degree (towards the northeast) and a second HRTF generated by the HRTF recording device 2 oriented at the same angle. Similarly, the HRTF for the chosen point 810Y may be simulated by cross fading the audio level of a first HRTF generated by the HRTF recording device 2 oriented at an angle of 315 degree (towards the northeast) and a second HRTF generated by the HRTF recording device 3 oriented at the same angle. FIG. 8B shows the diagrams of the HRTFs generated by the HRTF recording devices (1, 2, 3) which are oriented at an angle of 315 degree.

Figure 8C:
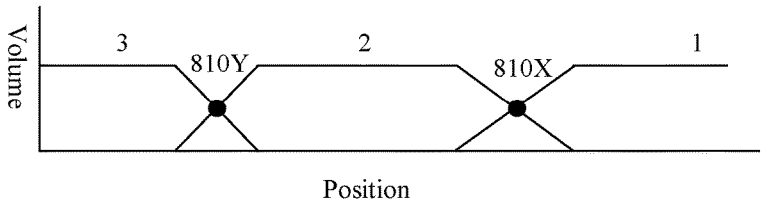
FIG. 8C a volume-position diagram for the chosen points of FIG. 8A to illustrate various aspects of the present disclosure.

The distance of the chosen point 810X from the point source 802 is between the distance D1 (i.e., the distance of the HRTF recording device 1 from the point source 802) and the distance D2 (i.e., the distance of the HRTF recording device 2 from the point source 802). Thus, the level of an audio signal at the chosen point 810X is a crossfade between the audio signals of the HRTF recording devices 1 and 2. FIG. 8C shows a volume-position diagram plotting the crossfaded volume (audio level) with respect to positions of the HRTF recording devices. Note that on the diagram the audio level at point 810X appears to be lower than the audio levels at D1 or D2 in actuality the perceived audio level is constant because the perceived audio at point 810X is the crossfaded addition of the signals D1 and D2.

According to another aspect of the present disclosure, HRTFs for different heights of HRTF recording devices in two or more different distances from a point source may be recorded. Each HRTF recording device may be placed in various heights for recording. With recordings of HRTFs by the HRTF recording devices in various heights (reference heights) and in two or more different locations, a HRTF may be generated for a chosen point from a point source in any heights. A HRTF for any given height of the chosen point different from the reference heights may be simulated by interpolating between two HRTFs generated for the heights nearest to the given height.

Once HRTFs haven been recorded for various distances, angles and/or heights with respect to a point source, a localized HRTF may be generated by interpolation for a chosen point at any height, in any angle and any distance from the point source. When an audio signal convolves with a localized HRTF for reproduction, a listener at the chosen point would perceive the sounds, when reproduced by the speakers in a surround sound system, as if they originate from the point source rather than the location of the speakers.

Figure 10:
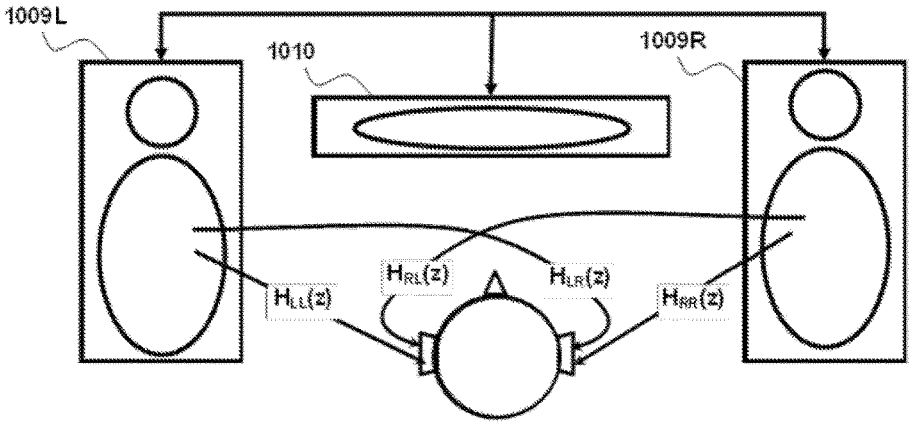
FIG. 10 is a diagram illustration cross talk cancellation with two speakers according to aspects of the present disclosure.

As noted above, a problem with loud speaker playback of HRTF localized signals is crosstalk. FIG. 10 shows cross talk cancellation for two speaker audio systems. In implementations involving loudspeakers the audio signal may be further modified by a cross-talk cancellation function 1010.

Cross-talk cancellation may be done using pairs of loudspeakers that are not part of a set of headphones. In mathematical terms, cross-talk cancellation involves inverting a 2×2 matrix of transfer functions, where each element of the matrix represents a filter model for sound propagating from one of the two speakers to one of the two ears of the listener. As seen in FIG. 10, the transfer function for the user's left ear includes a transfer function $H_{LL}(Z)$ for sound from the left speaker 1009L and a cross-talk transfer function $H_{RL}(z)$ for sound from the right speaker 1009R. Similarly, the transfer function for the user's right ear includes a transfer function $H_{RR}(Z)$ for sound from the right speaker 1009R and cross-talk transfer function $H_{LR}(Z)$ for sound from the left speaker 1009L.

The matrix inversion may be simplified if it can be assumed that the left ear and right ear transfer functions are perfectly symmetric in which case $H_{LL}(Z)=H_{RR}(z)=H_S(z)$ and $H_{RL}(z)=H_{LR}(Z)=H_O(z)$. In such situations, the matrix inversion becomes:

$$\begin{bmatrix} H_{LL}(z) & H_{LR}(z) \\ H_{RL}(z) & H_{RR}(z) \end{bmatrix}^{-1} \approx \begin{bmatrix} H_S(z) & H_O(z) \\ H_O(z) & H_S(z) \end{bmatrix}^{-1} = \frac{1}{H_S^2(z) - H_O^2(z)} \begin{bmatrix} H_S(z) & -H_O(z) \\ -H_O(z) & H_S(z) \end{bmatrix}$$

The main constraint in such situations is that $$\frac{1}{H_S^2(z) - H_O^2(z)}$$

must be stable. In many cases this may be physically realizable.

To determine the transfer functions and perform the matrix inversion one would need to know the position of each of the listener's ears (distance and direction). The cross-talk cancellation filters could be computed after the appropriate HRTF's are measured, and stored for later use. The same filters measured to capture the HRTF are the ones which would be used to compute the cross-talk cancellation filters.

The cross-talk cancellation filtering may be done after the HRTF convolution of the driving signal with the HRTF and just before playback over a pair of loudspeakers 1009L, 1009R. There would need to be some means of selecting which pair of speakers out of all the available ones to use if crosstalk cancellation cannot be done using more than two loudspeakers.

Figure 9:
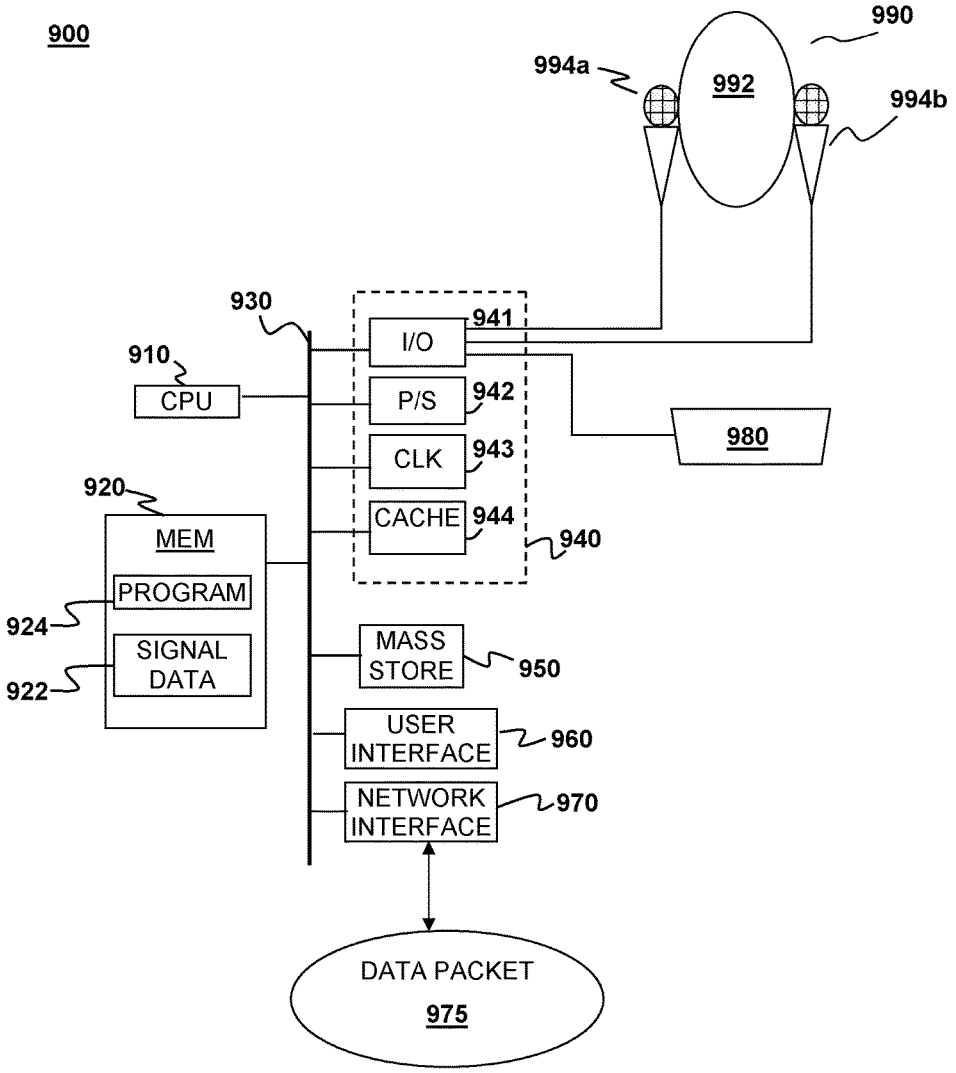
FIG. 9 is a block diagram illustrating a signal processing apparatus according to aspects of the present disclosure.

FIG. 9 shows a block diagram of an example apparatus 900 configured to localize sounds in accordance with aspects of the present disclosure. The example apparatus 900 may be incorporated in a surround sound system or an entertainment system, such as a TV, video game consoles, DVD player or setup/cable box connected with a surround sound system. The apparatus 900 may include a processor 910 and a memory 920 (e.g., RAM, DRAM, ROM, and the like). The processor 910 may be configured to process audio signal to convolve impulse responses in accordance with aspects of the present disclosure. In some implementations, the apparatus 900 may have multiple processors 910 if parallel processing is to be implemented. The memory 920 may include data 922 (e.g., source audio signals, recorded HRTFs) and programs 924 configured to process the data (e.g., interpolation, convolution) as described above.

The processor 910 may execute one or more programs, portions of which may be stored in the memory 920, and the processor 910 may be operatively coupled to the memory 920, e.g., by accessing the memory via a data bus 930. The programs may be configured to process source audio signal for converting the signals to virtual surround sound signals for reproduction. By way of example, and not by way of limitation, the programs 924 may include processor executable instructions which cause the apparatus 900 to filter one or more channels of a source signal with one or more filters (e.g., HRTF) representing one or more impulse responses to localize the sources of sounds in an output audio signal. The program 924 may conform to any one of a number of different programming languages such as Assembly, C++, JAVA or a number of other languages.

The apparatus 900 may also include well-known support functions 940, such as input/output (I/O) elements 941, power supplies (P/S) 942, a clock (CLK) 943 and cache 944. As used herein, the term I/O generally refers to any program, operation or device that transfers data to or from the apparatus 900 and to or from a peripheral device. Every data transfer may be regarded as an output from one device and an input into another. Peripheral devices include input-only devices, such as keyboards and mouses, output-only devices, such as printers as well as devices such as a writable CD-ROM that can act as both an input and an output device. The term "peripheral device" includes external devices, such as a mouse, keyboard, printer, monitor, speaker, microphone, game controller, camera, external Zip drive or scanner as well as internal devices, such as a CD-ROM drive, CD-R drive or internal modem or other peripheral such as a flash memory reader/writer, hard drive.

According to aspects of present disclosure, a plurality of speakers 980 may be coupled to the apparatus 900, e.g., through the I/O function 941. In some implementations, the plurality of speakers may be a set of surround sound speakers, which may be configured, e.g., as described above with respect to FIG. 2. In addition, according to aspects of present disclosure, a plurality of HRTF recording devices 990 may be coupled to the apparatus 900, e.g., through the I/O function 941. By way of example and not by way of limitation, in some implementations, each HRTF recording device may comprise a dummy head 992 and two or more microphones (994*a* and 994*b*) located on either side of the dummy head 992. In some implementations, some or all of the computing components may be embedded in the dummy head 992 for generating the localized HRTF for sound localization in accordance with aspects of the present disclosure. Furthermore, in some implementations, the apparatus 900 may be part of a surround sound system or entertainment system and the like.

The apparatus 900 may optionally include a mass storage device 950 such as a disk drive, CD-ROM drive, tape drive, or the like to store programs and/or data. The apparatus may also optionally include a user interface 960 to facilitate interaction between the apparatus 900 and a user. In some implementations, the apparatus 900 may execute one or more general computer applications such as a video game which may incorporate aspects of the sounds as computed by the program 924.

The apparatus 900 may include a network interface 970, configured to enable the use of Wi-Fi, an Ethernet port, or other communication methods. The network interface 970 may incorporate suitable hardware, software, firmware or some combination thereof to facilitate communication via a telecommunications network. The network interface 970 may be configured to implement wired or wireless communication over local area networks and wide area networks such as the Internet. The apparatus 900 may send and receive data and/or requests for files via one or more data packets 975 over a network It will be readily appreciated that many variations on the components depicted in FIG. 9 are possible, and that various ones of these components may be implemented in hardware, software, firmware, or some combination thereof. By way of example but not by way of limitation, some of the features or all the features of the convolution programs contained in the memory 920 and executed by the processor 910 may be implemented via suitably configured hardware, such as one or more application specific integrated circuits (ASIC) or a field programmable gate array (FPGA) configured to perform some or all aspects of the present disclosure.

While the above is a complete description of the preferred embodiment of the present invention, it is possible to use various alternatives, modifications and equivalents. Therefore, the scope of the present invention should be determined not with reference to the above description but should, instead, be determined with reference to the appended claims, along with their full scope of equivalents. Any feature described herein, whether preferred or not, may be combined with any other feature described herein, whether preferred or not. In the claims that follow, the indefinite article "A", or "An" refers to a quantity of one or more of the item following the article, except where expressly stated otherwise. The appended claims are not to be interpreted as including means-plus-function limitations, unless such a limitation is explicitly recited in a given claim using the phrase "means for."

What is claimed is:

1. A method for improved virtual localization of sound comprising:

a) recording a sound from an origin point with two or more recording devices, each of the two or more recording devices being configured to simulate a human head and ears, wherein each of the two or more recording devices is located in a different distance from the origin point;

b) generating a head-related transfer function (HRTF) for two or more signals corresponding to sounds received by the two or more recording devices;

c) convolving an input waveform with a localized HRTF generated using at least one of the HRTFs from b) to generate a convolved waveform, wherein convolving an input waveform with a localized HRTF further includes choosing a first HRTF that was generated with a first recording device from the two or more recording devices, wherein the first recording device is nearest to a chosen point from the origin point;

d) driving a speaker with the convolved waveform.

2. The method claim 1, wherein each of the two or more recording devices includes a pair of microphones separated by a horizontal distance between ears on an average human head and a head analog comprised of a material chosen to simulate a density of a human head.

3. The method of claim 1, further comprising interpolating between the first HRTF and a second HRTF generated with a second recording device from the two or more recording devices to produce the localized HRTF for the chosen point lying at a distance from the origin point that is between a first distance of the first recording device from the origin point and a second distance of the second recording device from the origin point.

4. The method claim 1, wherein generating a HRTF for each of signals received from the two or more recording devices at step b) includes generating an angle HRTF for different angles of each of the two or more recording devices from the origin point.

5. The method of claim 4 further comprising crossfading between a first and a second angle HRTF generated for a first and a second angle to generate a HRTF for a given angle between the first and the second angle.

6. The method of claim 3 further comprising generating an angle HRTF for different angles of the first and the second recording device; interpolating between a first-angle and a second-angle HRTF generated for a first and a second angle to produce the first HRTF and the second HRTF for a given angle between the first and the second angle.

7. The method of claim 1 further comprising generating a HRTF for each of signals received from the two or more recording devices at step b) includes generating a height HRTF for different heights for each of the two or more recording devices.

8. The method of claim 7 wherein convolving a waveform with a localized HRTF generated using at least one of the HRTFs at c) includes choosing a first height HRTF for a first height nearest to a height of a chosen point.

9. The method of claim 8 further comprising interpolating between the first height HRTF and a second height HRTF for a second height to produce a HRTF for a chosen point lying at a height that is between the first height and the second height.

10. The method of claim 3 further comprising generating a height HRTF for different heights for the first and the second recording device; interpolating between a first-height and a second-height HRTF for the chosen point lying at a given height between a first height and a second height to produce the first HRTF and the second HRTF for the chosen point lying at the given height.

11. The method of claim 3 further comprising crossfading between the first HRTF and the second HRTF.

12. The method of claim 1 wherein a) is carried out in an anechoic chamber.

13. The method of claim 1 wherein c) further comprises convolving the waveform with a Room Response Transfer function.

14. A system for creation of multiple Head-related Transfer Functions comprising:

a first recording device placed a first distance from an origin point;

a second recording device placed a second distance from the origin point;

each of the first and second recording devices comprising:

two or more microphones separated by a horizontal distance between ears on an average human head and a head analog comprised of a material chosen to simulate a density of a human head;

a processor coupled to the first and second head and ears analog;

a memory;

instructions embodied on the memory that when executed cause the processor to carry out the method comprising:

a) recording a sound with the first and the second recording device;

b) generating a head-related transfer function (HRTF) for each of signal received from the first and the second recording device at the first and the second distance from the origin point respectively;

c) convolving an input waveform with a localized HRTF generated using at least one of the HRTFs to generate a convolved waveform, wherein convolving an input waveform with a localized HRTF further includes choosing a first HRTF that was generated with a first recording device from the two or more recording devices, wherein the first recording device is nearest to a chosen point from the origin point;

d) driving a speaker with the convolved waveform.

15. The method of claim 14 wherein convolving a waveform with a localized HRTF generated using at least one of the HRTFs at c) includes choosing a first HRTF that was generated with one of the first and second recording devices at a distance nearest to a distance of a chosen point from the origin point.

16. The method claim 14, wherein the first HRTF for a given angle between a first and a second angle is generated by crossfading between a first angle HRTF and a second angle HRTF for the first and the second angle that the first recording device is oriented, and wherein the second HRTF for the given angle is generated by interpolating between a first angle HRTF and a second angle HRTF for the first and the second angle that the second recording device is oriented.

17. The method claim 14, wherein the first HRTF for a given height of the chosen point between a first and a second height is generated by interpolating between a first height HRTF and a second height HRTF for the first and the second height of the first recording device, and wherein the second HRTF for the given height is generated by interpolating between a first height HRTF and a second height HRTF for the first and the second height of the second recording device.

18. The method of claim 14 further comprising crossfading an audio level between the first HRTF and a second HRTF for the chosen point lying at a distance from the origin point that is between the first distance and the second distance.

* * * * *